US007284955B2

(12) United States Patent
Vieillefond et al.

(10) Patent No.: US 7,284,955 B2
(45) Date of Patent: Oct. 23, 2007

(54) FITTING OF DISTRIBUTOR SECTORS IN AN AXIAL COMPRESSOR

(75) Inventors: Guy Vieillefond, Evry (FR); Christophe Yvon Gabriel Tourne, Varennes Jarcy (FR); Bertrand Jean Joseph Marie Heurtel, Vert-Saint-Denis (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 11/283,787

(22) Filed: Nov. 22, 2005

(65) Prior Publication Data

US 2006/0133939 A1 Jun. 22, 2006

(30) Foreign Application Priority Data

Nov. 24, 2004 (FR) ..... 04 52746

(51) Int. Cl.
*F01D 9/04* (2006.01)

(52) U.S. Cl. ..... 415/190; 415/193

(58) Field of Classification Search ..... 415/134, 415/139, 190, 191, 193, 209.2
See application file for complete search history.

(56) References Cited

U.S. PATENT DOCUMENTS 3,365,173 A * 1/1968 Lynch et al. ..... 415/209.3
4,101,242 A 7/1978 Coplin et al.
5,118,253 A * 6/1992 Balkcum, III ..... 415/209.2
5,653,581 A * 8/1997 Dixon et al. ..... 415/209.2
5,655,876 A 8/1997 Rock et al.
6,296,443 B1 * 10/2001 Newman et al. ..... 415/209.2
2004/0033133 A1 2/2004 Muny
2004/0062652 A1 4/2004 Grant et al.

* cited by examiner

*Primary Examiner*—Richard A. Edgar
(74) *Attorney, Agent, or Firm*—Oblon, Spivak, McClelland, Maier & Neustadt, P.C.

(57) ABSTRACT

This present invention concerns an axial gas turbine engine compressor which includes a casing and a distributor wheel composed of a multiplicity of sectors in arcs of circles, with radial stator blades fixed to an external platform, characterised by the fact that the said platform is retained in the casing by two joints of the tongue and groove type, one upstream and the other downstream of the stator blades, the said downstream joint being formed between a transverse flange provided on the external platform and a flange provided on the casing, with a securing resource to create a tight joint between the two flanges. It is preferable that the securing resource should be a bolt.

The invention provides for effective retention of the sector so as to prevent wear in the surfaces in contact. The solution is easy to implement.

10 Claims, 3 Drawing Sheets

FITTING OF DISTRIBUTOR SECTORS IN AN AXIAL COMPRESSOR

This present invention concerns the area of gas turbine engines, and in particular of the aeronautical turbo-machines. It covers the fitting of compressor distributor sectors within the casing of the latter.

Such an engine includes a compressor feeding air to combustion chamber. The combustion gases exiting from it then pass into a succession of turbine stages. The turbine rotors drive the rotors of the compressor, as well as other devices.

In an axial turbo-machine, such as a compressor, the mobile stages, composed of rotor blades positioned radially in successive transverse planes, alternate with fixed distributors. A distributor is composed of stator blades positioned radially between two concentric platforms, delimiting the annular gas stream, and which axially corrects the flow between two stages.

In a turbofan engine, such as the CFM56 for example, which is in current use, the annular correctors of the compressor are subdivided into sectors, each covering a portion of the ring. To clarify the concept, a compressor distributor of the engine is composed of 10 sectors, for example, each with 9 blades. The sectors are retained within the casing by external platforms using a system of the tongue and groove type, both on the upstream edge and the downstream edge of the platforms. Upstream and downstream are defined in relation to the direction of the gas flow. The casing surrounding the compressor is of a general tapered shape, in two half sections or shells which are bolted together along longitudinal flanges located in a plane passing through the axis of rotation of the compressor. In a joint of the tongue and groove type, an annular groove, with the opening oriented axially, is machined in a flange attached to the inner wall of the casing or in a part that is fixed in relation to the casing, and accommodates a tongue in the arc of a circle, attached to the external platform of the sector. The groove and the tongue can be reversed.

A joint of this type has the disadvantage of causing significant wear to the parts which are in contact with each other, because of their relative movements due to thermal variations during the various phases of operation of the engine.

A solution to this problem is to immobilise the sectors of a corrector in relation to the casing, independently of each other, by creating a fixing point on each of the sectors.

Figure 1:
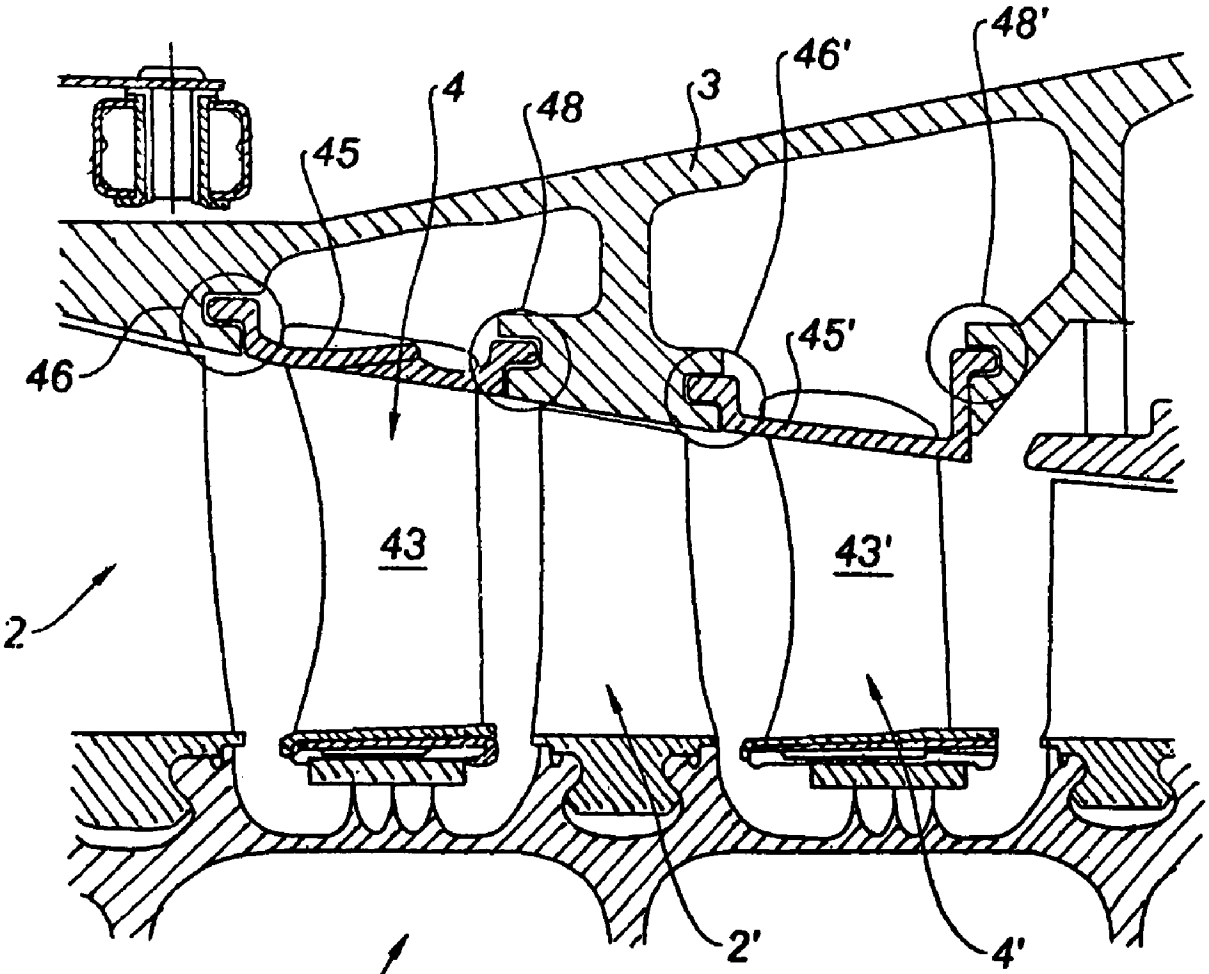
Fig. 1 BACKGROUND ART

FIG. 1 illustrates an implementation according to previous design techniques. The compressor 1 includes several mobile stages 2 alternating with correctors 4, 4' within a casing 3. The casing 3 is composed, for example, of two half casings joined at longitudinal flanges. Here, each sector of corrector includes a multiplicity of fixed blades 43, 43', suspended on an external platform 45, 45'. This platform 45, 45' is held upstream by a first joint 46, 46' of the tongue and groove type, and downstream by a second tongue and groove joint 48, 48'. It can be seen that stage 4' includes an air intake downstream. This service air is channelled from the opening to other devices, including other parts of the engine requiring an air feed, to cool the rotor or the blades of the high pressure turbine stage, for example. The sectors are secured by bolts opposite to the half casings. As a result of expansion phenomena, wear can be observed in the grooves.

A method already employed elsewhere consists of attaching the platform to the external housing by means of a connecting bolt. This method allows each sector to be retained effectively, and reduces the relative movements between the parts. However this arrangement involves quite complex geometry and the manufacture of the parts is rendered costly.

The problem arises most acutely in respect of compressor stage 4', which includes an opening for the service air intake. The geometry of the external platform at the level of the attachment to the casing would be particularly complex in this case, and difficult to implement industrially.

The subject of the invention is a means of ensuring both the sealing of the external platform and the individual securing of each sector of distributor, while also being robust and easy to implement. The invention should apply in particular to the stage of the compressor in which an air intake opening is provided.

This objective has been met successfully by means of an axial gas turbine engine compressor that includes a casing and at least one distributor wheel composed of a multiplicity of circular arc sectors with radial stator blades, fixed to an external platform, characterised by the fact that the said platform is retained in the casing by two joints of the tongue and groove type, one upstream and the other downstream of the stator blades, the said downstream joint being formed between a transverse flange provided on the external platform, and a flange provided on the casing, a securing method which ensured a tight joint between the two flanges. In particular, the said joint is formed by an axially opening groove created in the flange of the casing, and the tongue is created on the flange of the external platform. It is preferable that the fixing method should include a bolt passing through the two flanges.

By combining the tongue and groove joint with the securing point of the sector, the solution of the invention has the advantage of ensuring a particularly effective immobilisation of each of the sectors, with its guidance along the grooves during the expansion phases, without introducing complexity into the part. It is possible, in particular, to make the tongue thicker so as to allow the drilling of an orifice. This thickness further enhances the robustness of the sector.

Advantageously, the bolt is positioned axially, and more precisely it passes through the tongue and the bottom of the groove. The tongue is thus clamped hard down against the bottom of the groove. It is advantageously adjusted to slide on its external diameter with a slight play on its internal diameter. This arrangement allows the sectors to be held in position and ensures the placement of the aerodynamic flow, without introducing any particular mechanical stresses in operation.

According to one particular method of implementation which improves the security of the assembly, the fixing method includes two bolts.

According to another characteristic, the securing resource is provided in the median part of the sector, with the sector able to expand freely to either side of the securing resource.

This fitting applies preferably to the sectors of the distributor that have an air intake.

Figure 2:
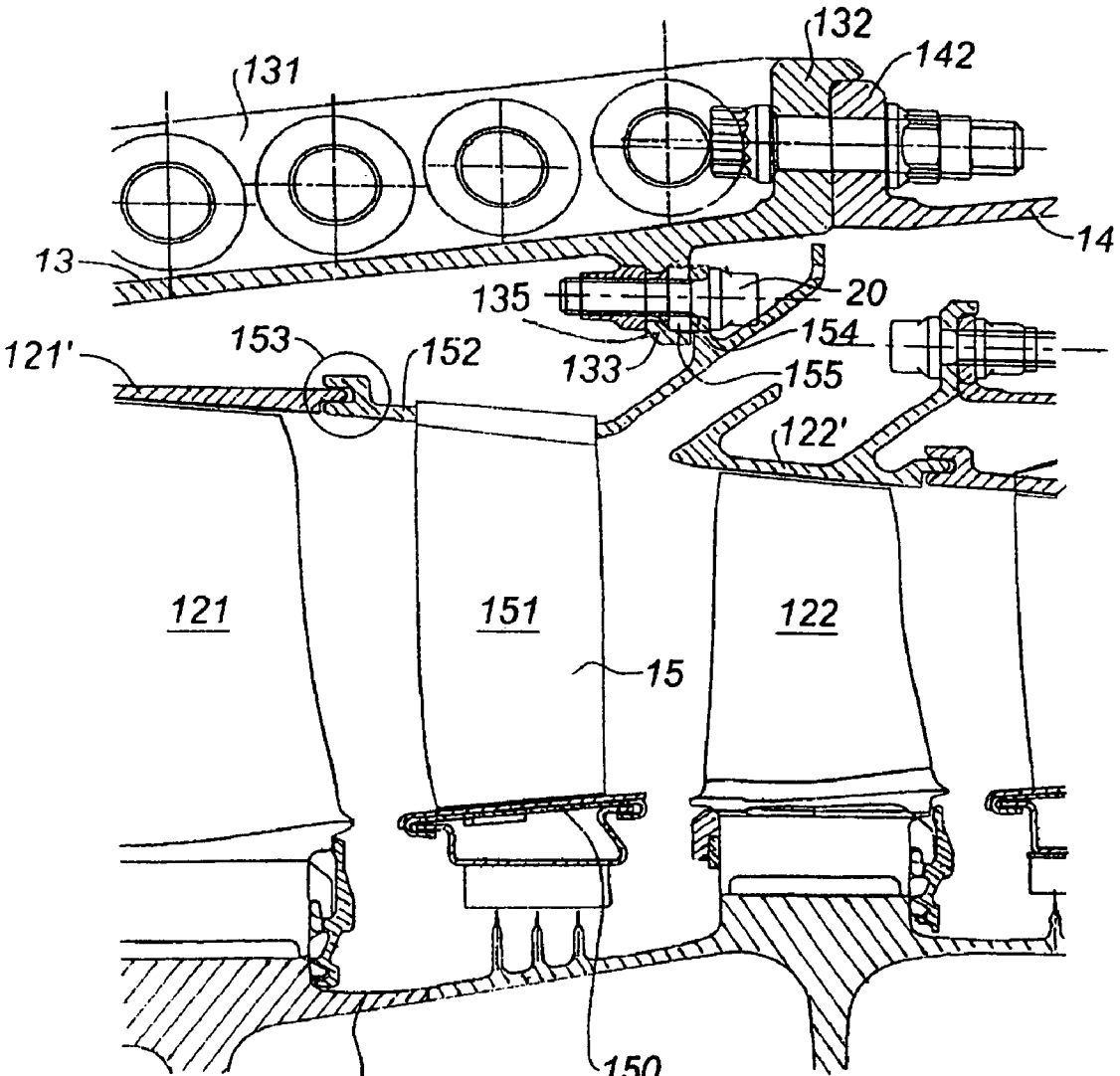
Figure 3:
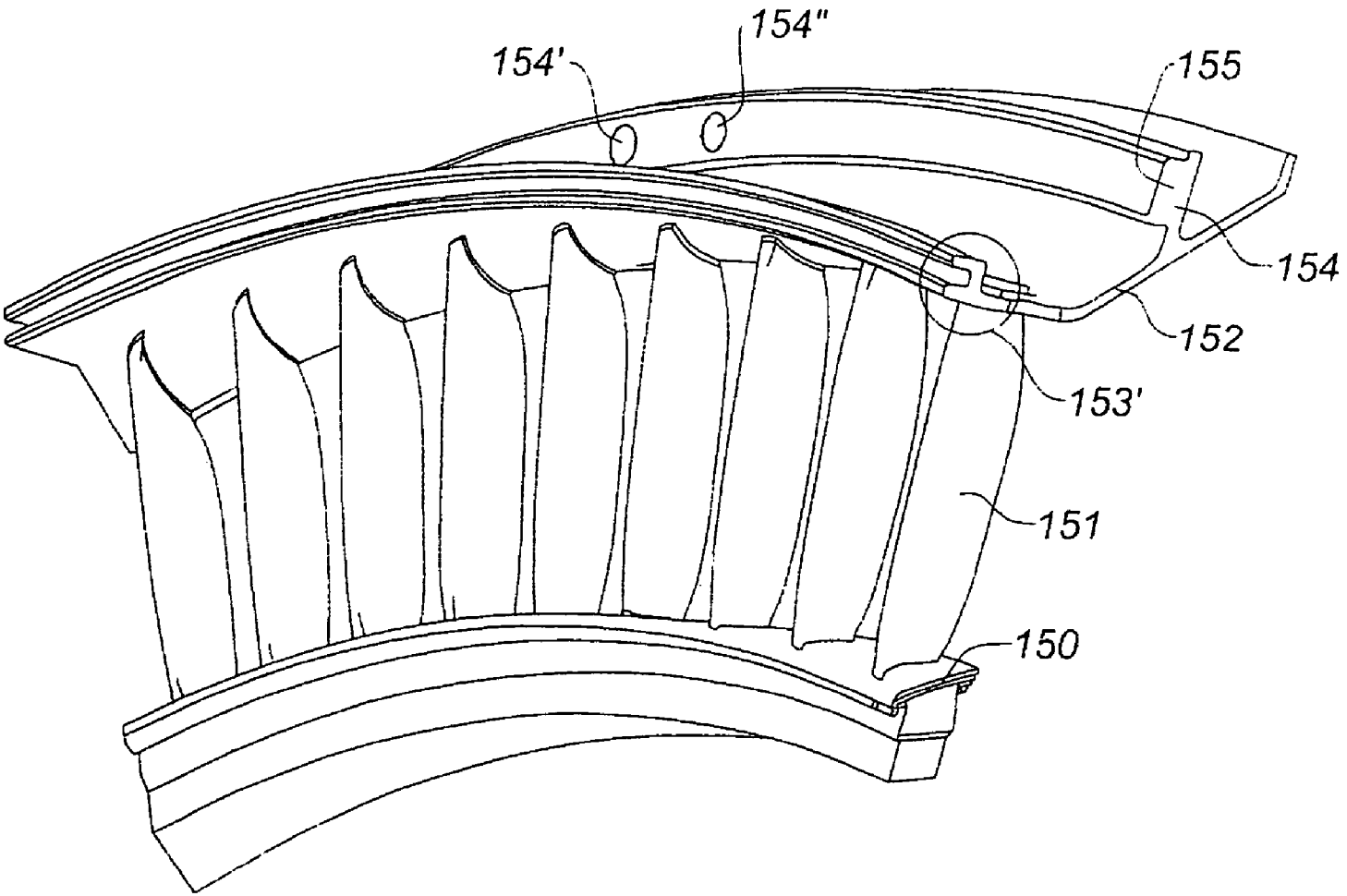

The invention will now be described in greater detail, with reference to the drawings in which:

FIG. 1 shows, in axial section, one part of the compressor of a known gas turbine engine, FIG. 2 represents, in axial section; a portion of a compressor with a correcting sector assembly according to the invention, FIG. 3 shows, in perspective, a single distributor sector according to the invention.

FIG. 2 illustrates the part of a compressor that includes the assembly of the invention. This compressor is incorporated into a gas turbine engine which is not shown here. The air coming from the earlier stages is compressed and then conducted to the later stages of the compressor feeding the combustion chamber of the engine in the familiar manner.

Here, the casing 13 is of the type with two half casings bolted along longitudinal flanges 131. This casing element is bolted onto a downstream casing 14 by transverse flanges, 132 and 142 respectively.

The casing encloses the rotor 12 on which can be seen two mobile stages 121 and 122, the blades of which sweep through the volume delimited by the annular sealing platelets 121' and 122'. Between the two mobile stages, a fixed corrector provides for the guidance of the air and its axial correction, from stage 121 to the next stage 122. The corrector is composed of a multiplicity of annular sectors 15, seen in perspective in FIG. 3. Each sector 15 includes stator blades 151 extending between two platforms—a lower platform 150 on the engine axis side, and an external platform 152 on the casing side. The sector is retained in the casing by a tongue and groove joint upstream 153. This joint includes a groove 153' provided along the upstream edge of the platform 152, and a tongue on the downstream edge of the platelet 121 ' surrounding the mobile stage 121.

Downstream, platform 152 is of flared shape and forms an air intake opening with the annular platelet 122' of the downstream mobile stage 122. On its outer face, the platform includes a transverse flange 154 as can be seen in FIG. 3. This flange is extended upstream by an axial tongue 155 over the whole platform. This tongue is drilled with two axial holes 154' and 154" in the median zone of the sector.

The tongue 155 mates with a groove 135 provided in a transverse flange 133 of the casing 13. As can be seen in FIG. 2, the tongue fits into groove 135. The width of the annular groove 135 allows precise adjustment of the tongue. It is preferable, as already mentioned above, that the tongue should be adjusted to slide in the groove on its outer diameter, with a slight play on its inner diameter. In this example, two bolts 20 have been introduced into the two holes 154' and 154". Only one is shown in FIG. 2. The bolts are tightened so as to prevent any movement of the sector in relation to the casing. The sector can nevertheless expand as a function of the temperature conditions to which it is subjected. This arrangement allows a tangential expansion of the sector which is guided by the tongue and groove joint. Its central fixing thus allows tangential expansion without the creation of any mechanical stresses. Some play must be provided between two adjacent sectors when cold in order that no interference should occur between them in operation.

Implementation variants are possible, without going outside the framework of the invention.

A single bolt can be used.

It is also possible to employ a securing resource other than bolts, such as a clamp or any other equivalent means.

The tongue and groove joint can be reversed.

The invention claimed is:

1. An axial gas turbine engine compressor comprising:

a casing; and a plurality of distributor wheels, each comprising a plurality of sectors in arcs of circles, each sector including an external platform and a plurality of radial stator blades arranged in a row and fixed to an external platform, wherein each external platform is individually retained in the casing by an upstream joint and a downstream joint, said downstream joint formed between a first transverse flange provided on each external platform and a second flange provided on the casing, wherein the upstream joint is located upstream of the plurality of radial stator blades and the downstream joint is located downstream of the plurality of stator blades, wherein the upstream joint and downstream joint are tongue and groove joints, and wherein the first and second flange are secured to each other by a securing mechanism.

2. A compressor according to claim 1, wherein said downstream joint is formed by an axially-opening groove provided in the second flange of the casing, and a tongue provided on the first transverse flange of the external platform.

3. A compressor according to claim 1, wherein the securing mechanism includes a bolt traversing the first transverse flange and the second flange.

4. A compressor according to claim 3 wherein the bolt is positioned axially with respect to the gas turbine compressor.

5. A compressor according to claim 3, wherein the bolt passes through a bottom portion of an axially-opening groove provided in the second flange of the casing, and a tongue provided on the first transverse flange of the external platform.

6. A compressor according to claim 3, wherein the securing mechanism includes two bolts.

7. A compressor according to claim 1, wherein the securing mechanism is provided in a median part of one of the plurality of sectors such that the one of the plurality of sectors is able to expand freely to either side of the securing mechanism.

8. A compressor according to claim 1, wherein the sectors of the distributor create an air intake.

9. A compressor according to claim 1, wherein each sector is an integral unit that is individually secured to the casing.

10. A gas turbine engine comprising the axial gas turbine engine compressor according to claim 1.

* * * * *